US009056258B2

(12) United States Patent
Handy et al.

(10) Patent No.: US 9,056,258 B2
(45) Date of Patent: Jun. 16, 2015

(54) TOY FIGURES

(75) Inventors: Derek Handy, North Hollywood, CA (US); Henry Jen, Monterey Park, CA (US); Lung Yau Choi, North Point (HK)

(73) Assignee: Mattel, Inc., El Segundo, CA (US)

( * ) Notice: Subject to any disclaimer, the term of this patent is extended or adjusted under 35 U.S.C. 154(b) by 1015 days.

(21) Appl. No.: 12/709,365

(22) Filed: Feb. 19, 2010

(65) Prior Publication Data

US 2011/0189922 A1 Aug. 4, 2011

Related U.S. Application Data

(60) Provisional application No. 61/299,854, filed on Jan. 29, 2010.

(51) Int. Cl.
*A63H 3/46* (2006.01)

(52) U.S. Cl.
CPC ..... *A63H 3/46* (2013.01)

(58) Field of Classification Search
CPC ..... A63H 3/46
USPC ..... 446/383
See application file for complete search history.

(56) References Cited

U.S. PATENT DOCUMENTS

| | | | |
|---|---|---|---|
| 172,709 | A | 1/1876 | Crandall |
| 246,867 | A | 9/1881 | Cooke |
| 292,919 | A | 2/1884 | Kihlgren |
| 487,861 | A | 12/1892 | Verpillier |
| 546,791 | A | 9/1895 | Verpillier et al. |
| 703,899 | A | 7/1902 | Debes |
| 982,096 | A | 1/1911 | Schoenhut |
| 1,270,781 | A | 7/1918 | Cabana |
| 1,359,030 | A | 11/1920 | Cabana |
| 1,456,422 | A | 5/1923 | Cabana |
| 1,556,095 | A | 10/1925 | Gans |
| 1,589,750 | A | 6/1926 | Gans |
| 1,601,447 | A | 9/1926 | Huck |
| 1,620,069 | A | 3/1927 | Bucherer |
| 2,021,115 | A | 11/1935 | Jackson |
| 2,552,216 | A | 5/1951 | Rekettye |
| 2,778,156 | A | 1/1957 | Zanca |
| 2,780,030 | A | 2/1957 | Beebe |
| 3,254,142 | A | 6/1966 | Ostrander |
| 3,277,602 | A | 10/1966 | Speers et al. |
| 3,350,812 | A | 11/1967 | Lindsay et al. |
| 3,466,793 | A | 9/1969 | Pugh et al. |
| 3,628,282 | A | 12/1971 | Johnson et al. |
| 3,699,710 | A | 10/1972 | Glass et al. |
| 3,716,942 | A | 2/1973 | Garcia et al. |
| 3,727,343 | A | 4/1973 | Chiari |

(Continued)

FOREIGN PATENT DOCUMENTS

| | | |
|---|---|---|
| EP | 0117428 | 8/1987 |
| FR | 2666514 | 7/1990 |

(Continued)

*Primary Examiner* — Michael Dennis
(74) *Attorney, Agent, or Firm* — Kolisch Hartwell, PC

(57) ABSTRACT

Toy figures may include a torso, an elongate member extending from the torso, an articulation element, and a limb having a socket. The elongate member may include an end region. The articulation element may be molded substantially around the end region and may be received within the socket. The socket may be configured for pivotable movement about the articulation element. Some examples of toy figures may include a hip joint assembly.

16 Claims, 4 Drawing Sheets

(56) References Cited

U.S. PATENT DOCUMENTS

| | | | | |
|---|---|---|---|---|
| 3,740,894 | A | 6/1973 | Howland et al. | |
| 3,921,332 | A | 11/1975 | Terzian et al. | |
| 3,938,277 | A | 2/1976 | Goldfarb et al. | |
| 3,940,880 | A | 3/1976 | Kaelin et al. | |
| 3,947,994 | A | 4/1976 | Meyer et al. | |
| 3,955,311 | A | 5/1976 | Lyons et al. | |
| 3,982,354 | A | 9/1976 | Hollingsworth et al. | |
| 3,988,855 | A | 11/1976 | Crabtree et al. | |
| 4,006,555 | A | 2/1977 | England et al. | |
| 4,242,830 | A | 1/1981 | Hauser | |
| 4,268,991 | A | 5/1981 | Cotey et al. | |
| 4,274,224 | A | 6/1981 | Pugh et al. | |
| 4,279,099 | A | 7/1981 | Dyer et al. | |
| 4,290,181 | A | 9/1981 | Jackson | |
| 4,571,209 | A | 2/1986 | Manning et al. | |
| 4,579,542 | A | 4/1986 | Mauer et al. | |
| 4,595,379 | A | 6/1986 | Ramussen et al. | |
| 4,623,318 | A | 11/1986 | Tsiknopoulos et al. | |
| 4,643,691 | A | 2/1987 | Keiji | |
| 4,662,857 | A | 5/1987 | Quinn et al. | |
| 4,669,998 | A | 6/1987 | Amici et al. | |
| 4,673,374 | A | 6/1987 | Kelley | |
| 4,680,019 | A | 7/1987 | Baerenwald et al. | |
| 4,708,687 | A | 11/1987 | Goldberg et al. | |
| 4,738,649 | A | 4/1988 | Delli Bovi et al. | |
| 4,790,789 | A | 12/1988 | Mathis | |
| 4,854,911 | A | 8/1989 | Berliner et al. | |
| 4,954,118 | A | 9/1990 | Refabert | |
| 4,968,282 | A | 11/1990 | Robson et al. | |
| 4,995,846 | A | 2/1991 | Mariol | |
| 5,017,173 | A | 5/1991 | Shapero et al. | |
| 5,044,960 | A | 9/1991 | De Porterous | |
| 5,257,873 | A | 11/1993 | Abbat | |
| 5,334,073 | A | 8/1994 | Tilbor et al. | |
| 5,989,658 | A | 11/1999 | Miura et al. | |
| 6,089,950 | A | 7/2000 | Lee et al. | |
| 6,110,002 | A | 8/2000 | Langton | |
| 6,220,922 | B1 | 4/2001 | Lee et al. | |
| 6,287,166 | B1 * | 9/2001 | Lee et al. | 446/376 |
| 6,296,543 | B1 | 10/2001 | Andrews | |
| 6,328,625 | B1 | 12/2001 | Lee et al. | |
| 6,419,546 | B1 | 7/2002 | Akashi et al. | |
| 6,422,916 | B1 | 7/2002 | Enku | |
| 6,435,938 | B1 | 8/2002 | Lee et al. | |
| 6,478,653 | B1 * | 11/2002 | Langton | 446/373 |
| 6,482,068 | B2 | 11/2002 | Lee et al. | |
| 6,494,763 | B1 | 12/2002 | Hastey | |
| 6,601,326 | B1 | 8/2003 | Bubitz et al. | |
| 6,638,136 | B1 | 10/2003 | Lee et al. | |
| 6,659,315 | B2 | 12/2003 | Talaric et al. | |
| 6,692,332 | B2 | 2/2004 | Jheow | |
| 6,817,921 | B2 | 11/2004 | Chin et al. | |
| 6,869,331 | B2 | 3/2005 | Lee et al. | |
| 6,893,318 | B2 | 5/2005 | Soviknes et al. | |
| 7,021,989 | B2 | 4/2006 | Wai | |
| 2002/0127949 | A1 | 9/2002 | Lee et al. | |
| 2003/0119418 | A1 | 6/2003 | Langton | |
| 2004/0082265 | A1 | 4/2004 | Langton | |
| 2004/0092202 | A1 | 5/2004 | Volynsky | |
| 2004/0092203 | A1 | 5/2004 | Lee et al. | |
| 2004/0092204 | A1 | 5/2004 | Lee et al. | |
| 2004/0198163 | A1 | 10/2004 | Wai | |
| 2006/0089079 | A1 | 4/2006 | Enku | |
| 2006/0228985 | A1 | 10/2006 | Wai | |
| 2006/0292965 | A1 | 12/2006 | Strauss | |
| 2007/0281582 | A1 | 12/2007 | Himstedt | |

FOREIGN PATENT DOCUMENTS

| | | |
|---|---|---|
| GB | 2153904 | 8/1985 |
| GB | 2201899 | 9/1988 |
| GB | 2218032 | 11/1991 |
| JP | 62128719 | 6/1987 |
| JP | 51698772 | 7/1993 |
| JP | 2004073514 | 3/2004 |
| JP | 2005034398 | 2/2005 |
| WO | 2004014507 | 2/2004 |
| WO | 2008137736 | 11/2008 |

* cited by examiner

TOY FIGURES

RELATED APPLICATION

This application claims priority under 35 U.S.C. §119(e) to U.S. Provisional Patent Application Ser. No. 61/299,854, which was filed on Jan. 29, 2010 and is entitled "TOY FIGURES." The complete disclosure of the above-identified patent application is hereby incorporated by reference for all purposes.

BACKGROUND

Examples of toy figures and associated components are disclosed in U.S. Pat. Nos. 1,456,422; 3,277,602; 5,989,658; 6,089,950; 6,110,002; 6,296,543; 6,422,916; 6,817,921; 6,869,331; and 7,021,989; in U.S. Patent Application Publication Nos. US20020127949; US20030119418; US20040082265; US20040092202; US20040092203; US20040092204; US20040198163; US20060089079; US20060228985; US20060292965 and US20070281582; and in JP62128719A; JP2004073514A and JP2005034398A. The disclosures of these and all other publications referenced herein are incorporated by reference in their entirety for all purposes.

SUMMARY

In some examples, a toy figure may include a torso, an elongate member extending from the torso, an articulation element, and a limb having a socket. The elongate member may include an end region, and the articulation element may be molded substantially around the end region. The articulation element may include a substantially cylindrical portion. The articulation element may be received within the socket. The socket may be configured for pivotable movement about the articulation element.

In some examples, a toy figure may include a torso, an elongate member, first and second articulation elements, and first and second limbs. The elongate member may be mounted to the torso and may include first and second end regions. The first and second articulation elements may be molded over respective ones of the first and second end regions. The first and second articulation elements may be substantially immovable relative to the elongate member. The first limb may include a first socket, which may be configured to receive the first articulation element and permit rotation of the first limb relative to the first articulation element. The second limb may include a second socket, which may be configured to receive the second articulation element and permit rotation of the second limb relative to the second articulation element.

In some examples, a toy figure may include a hip joint assembly. Such toy figures may include a torso and at least one leg connected to the torso by the hip joint assembly. The hip joint assembly may include a hip member, an articulation element and a leg member. The hip member may include an enlarged end region. The articulation element may be insert-molded onto the end region and may be substantially immovable relative to the end region. The leg member may include a socket configured to receive the articulation element for pivotable movement of the leg member relative to the articulation element.

DETAILED DESCRIPTION

Figure 1:
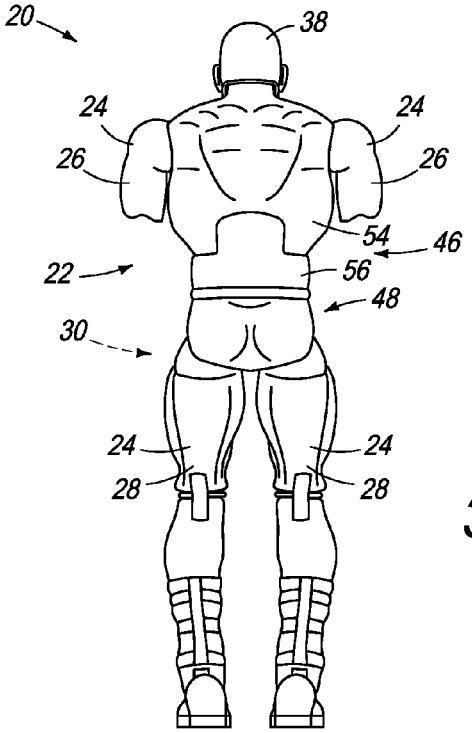
FIG. 1 is a perspective view of a nonexclusive illustrative example of a toy figure.

A nonexclusive illustrative example of an action or toy figure is shown generally at 20 in FIG. 1. Unless otherwise specified, toy FIG. 20 may, but is not required to, contain at least one of the structures, components, functionalities, concepts, and/or variations described, illustrated, and/or incorporated herein. The toy FIG. 20 may include a trunk or torso 22, at least one limb 24, such as an arm 26 or leg 28. At least one joint assembly 30 that may connect a limb 24 to the torso 22.

In some examples, the torso 22 may include one or more points of articulation or joints 36. Each of the joints 36 may permit various degrees of freedom and/or movement within or relative to the torso 22, the limbs 24 and/or the head 38. In particular, any one or more of the joints may permit rotation or pivoting about a single axis, or any one or more of the joints may permit motion about two or more axes. In the example shown in FIGS. 2 and 4, the torso 22 includes a neck joint 40 and first and second waist joints 42, 44. The neck joint 40 may permit twisting of the head 38 and/or it may permit pivoting the head 38 side-to-side and/or front-to-back relative to the torso 22.

Figure 2:
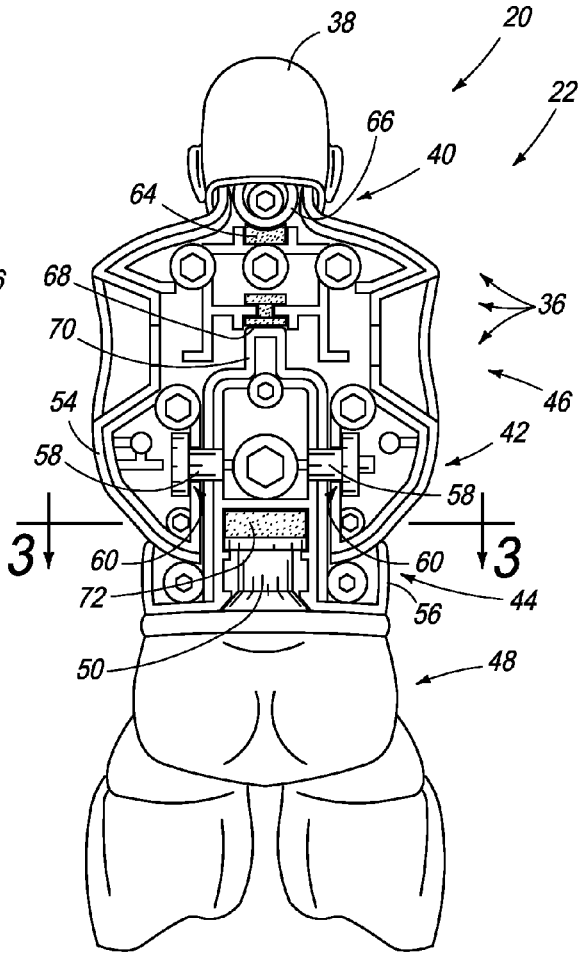
FIG. 2 is another perspective view of the toy figure of FIG. 1, with the back of the toy figure removed.
Figure 4:
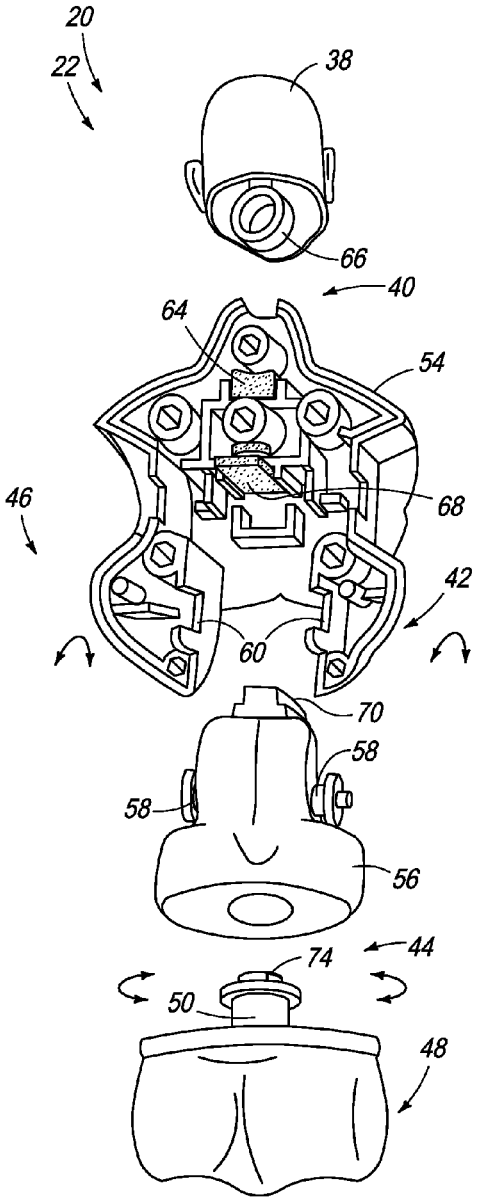
FIG. 4 is an exploded perspective view of portions of the toy figure of FIG. 1.

The first waist joint 42 may permit side-to-side twisting of an upper portion 46 of the torso 22 relative to a lower portion, such as the hip region 48, of the torso 22. As shown in the example of FIGS. 2 and 4, the upper portion 46 may twist or pivot around a post 50 projecting from the hip region 48.

The second waist joint 44 may permit front-to-back pivoting of a chest part 54 of the upper portion 46 of the torso 22 relative to a waist part 56 of the upper portion 46 of the torso. As shown in the example of FIGS. 2 and 4, the waist part 56 may include a pair of opposed axles 58 that are seated in a pair of openings or seats 60 within the chest part 54.

Figure 3:
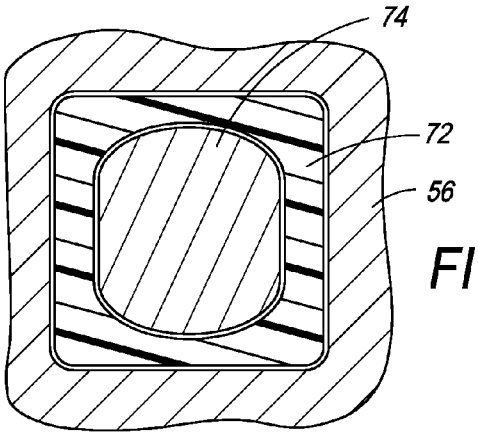
FIG. 3 is a sectioned partial view of the toy figure of FIG. 1, taken generally along line 3-3 in FIG. 2.

In some examples, at least some of the joints 26 may include a frictional element that may tend to impede relative movement between the joined parts and/or may tend to retain the joined parts in a selected orientation relative to each other. For example, as shown in FIGS. 2 and 4, the neck joint 40 may include a seat or pad 64 disposed within the chest part 54 that bears against a neck member 66 of the head 38. The first waist joint 42 may include a pad 68 disposed within the chest part 54 that bears against a projection 70 on the waist part 56. The second waist joint 44 may include a pad 72 disposed within the waist part 56 that engages a top part 74 of the post 50. As shown in FIG. 3, one or more of the pad 72 and the top part 74 of the post 50 may have a non-radially symmetric cross-section where the pad 72 engages the top part 74. The frictional elements may be fabricated from a suitable material, which may be a thermoplastic, and may be relatively pliable and/or soft such as to permit deformation of the frictional elements and/or enhance the coefficient of friction relative to the frictional elements.

Figure 5:
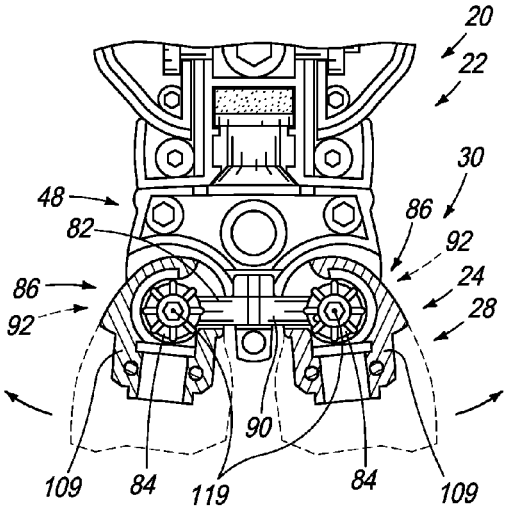
FIG. 5 is a partial view of the toy figure of FIG. 1, with the legs in a first rotational position and showing a nonexclusive illustrative example of a joint assembly with the back upper leg portions removed and with the crosshatching on the front upper leg portions indicating the mating surfaces thereof.
Figure 6:
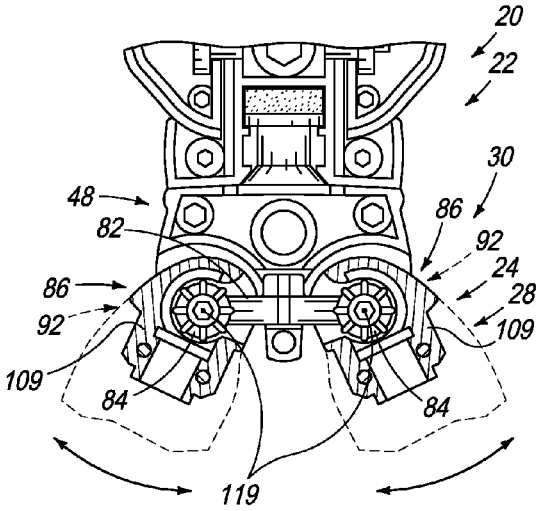
FIG. 6 is another partial view of the toy figure of FIG. 1 and the joint assembly of FIG. 5, with the legs in a second rotational position.
Figure 7:
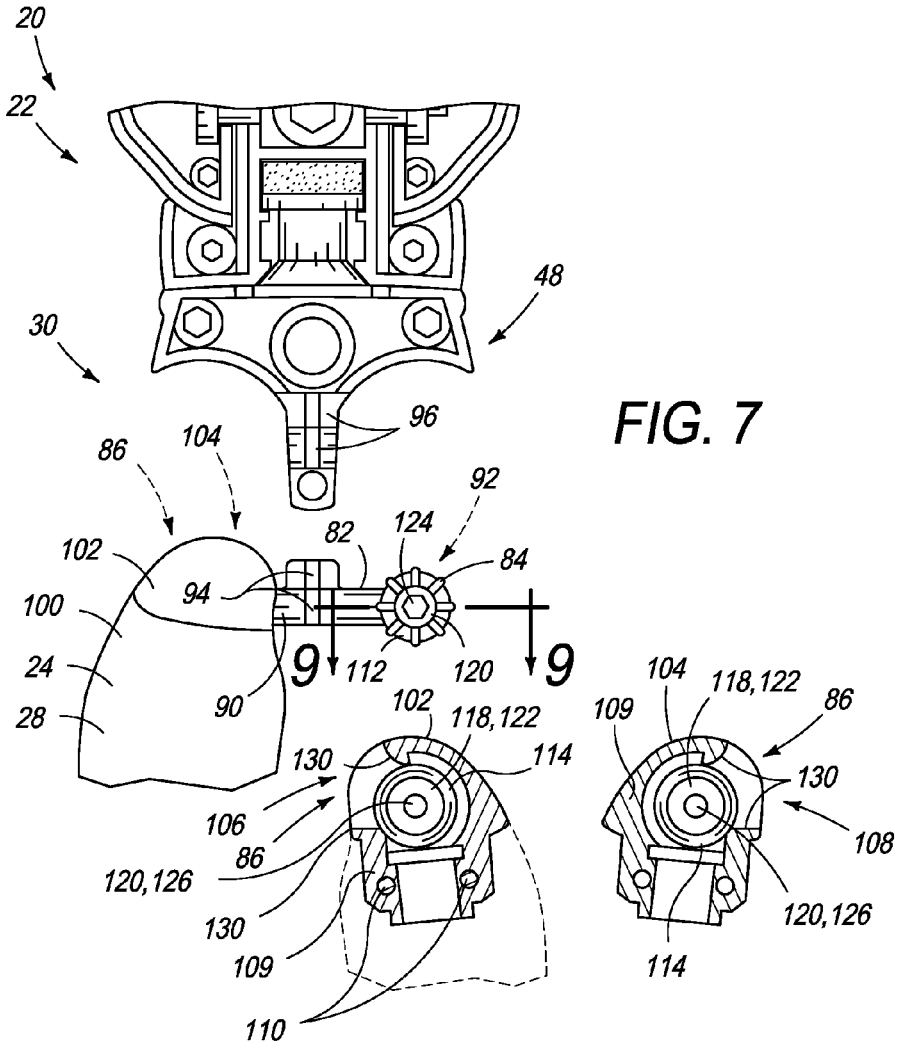
FIG. 7 is an exploded view of the joint assembly of FIG. 5, with the left-side upper leg portions in place and the right-side upper leg portions shown separated from the articulation element, with the crosshatching on the right-side upper leg portions indicating illustrative mating surfaces thereof.

A nonexclusive illustrative example of a joint assembly 30 is shown in FIGS. 5-7. Unless otherwise specified, joint assembly 30 may, but is not required to, contain at least one of the structures, components, functionalities, concepts, and/or variations described, illustrated, and/or incorporated herein. The joint assembly 30 may include an elongate member 82, at least one articulation element 84, and at least one socket 86 within or on each of the limbs 24 associated with the joint assembly 30. Each of the sockets 86 may be configured to receive one of the articulation elements 84.

In some examples, the joint assembly 30 may be configured as a hip joint assembly, such as the nonexclusive illustrative example shown in FIGS. 5-7, where the joint assembly 30 connects a leg 28 to the torso 22. When the joint assembly 30 is configured as a hip joint assembly, the elongate member 82 may be configured as a hip member. However, in some examples, the joint assembly may connect a different limb, such as an arm, to the torso. Furthermore, the joint assembly 30 may be used for connecting elements other than limbs to the torso.

Figure 8:
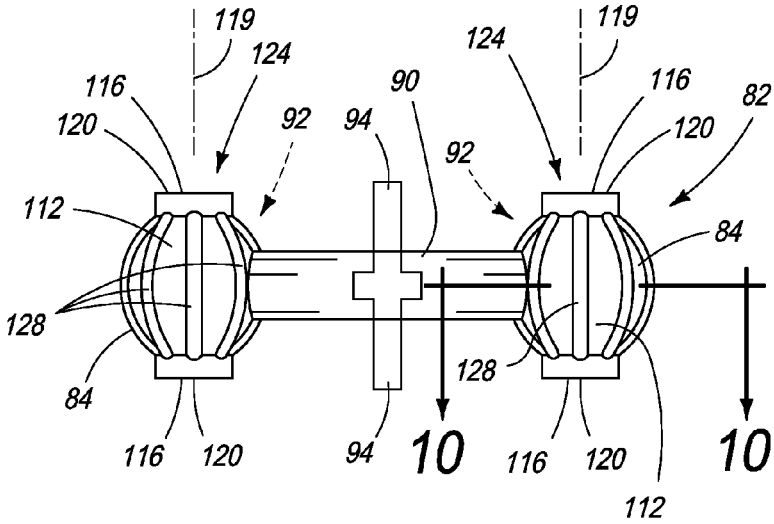
FIG. 8 is an elongate member suitable for use with the joint assembly of FIG. 5.
Figure 9:
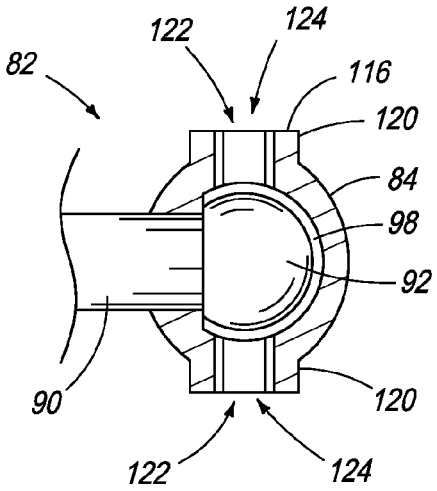
FIG. 9 is a partially sectioned partial view of the elongate member of FIG. 8, taken generally along line 9-9 in FIG. 7, with only the articulation element being sectioned.
Figure 10:
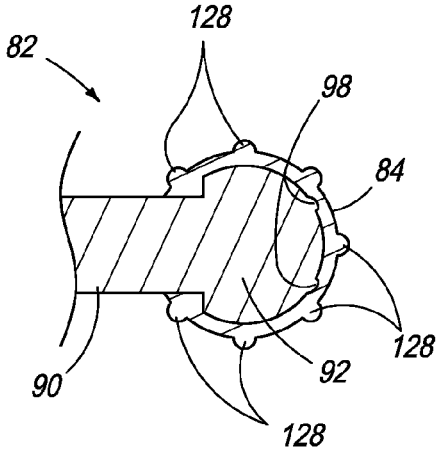
FIG. 10 is a sectioned partial view of the elongate member of FIG. 8, taken generally along line 10-10 in FIG. 8.

The elongate member 82 may be mounted to and extend from the torso 22. As shown in the example of FIGS. 5-7, the elongate member 82 may be mounted to and extend from the hip region 48 of the torso 22. As shown in FIGS. 8-10, the elongate member 82 may include a shaft section 90 that extends toward at least one end region 92, which may be enlarged relative to the shaft section 90. As generally shown in the example of FIGS. 5-7, the elongate member 82 may extend from the torso to first and second opposed end regions 92. However, in some examples, the elongate member may extend from the torso to a single end region.

In some examples, one or more projections of tabs 94 may be disposed on the shaft section of the elongate member 82. As shown in FIGS. 7 and 8, the tabs 94 may be configured to engage appropriate features 96 on the torso 22. Engagement between the tabs 94 and the features 96 may assist with mounting the elongate member 82 to the torso 22 and/or may limit or prevent rotation of the elongate member relative to the torso.

Each of the articulation elements 84 may be molded substantially around, onto and/or over an end region 92 of the elongate member 82. As shown in FIG. 8, first and second articulation elements 84 may be molded onto respective ones of the first and second opposed end regions 92 of the elongate member 82.

In some examples, an articulation element 84 may be overmolded or insert-molded onto, around or over one or more of the end regions 92 of the elongate member 82. In particular, an elongate member may initially be formed or molded from a first material, with a second material being subsequently injected into a mold cavity around an end region to form or mold the articulation element substantially around the end region in an insert molding process. In some examples, the elongate member 82 may be molded from or comprise a suitable first thermoplastic material, with the articulation elements 84 being molded from or comprising a suitable second thermoplastic material that may be different from the first thermoplastic material. In some examples, the second thermoplastic material may have a melting point lower than the melting point of the first thermoplastic material. In some examples, the second thermoplastic material may be softer than the first thermoplastic material. By way of nonexclusive illustrative example, a suitable first thermoplastic material for the elongate member 82 may be nylon, acrylonitrile butadiene styrene (ABS) or polyoxymethylene (POM), while a suitable second thermoplastic material for the articulation elements 84 may be polyvinyl chloride (PVC) or styrene butadiene. In some examples, the first thermoplastic material, such as when it is POM, may have a melting point within a range of about 160° C. to about 180° C., while the second thermoplastic material, such as when it is PVC, may have a melting point within a range of about 100° C. to about 180° C.

In some examples, the articulation elements 84 may be substantially immovable relative to the respective ones of the end regions 92 onto which the articulation elements 84 are molded. The articulation elements 84 may be chemically, adhesively and/or mechanically bonded or engaged with the end regions 92. Chemical and/or adhesive bonding may occur and/or be included in the manufacturing process in which the articulation elements 84 are molded onto the end regions 92. Mechanical bonding or engagement may result from one or more features formed onto the end regions 92 of the elongate element 82. For example, as shown in FIGS. 9 and 10, the end regions 92 may include one or more features, such as steps or ledges 98, that may tend to fix and/or lock the articulation element 84 to the end region 92 and/or impede relative movement therebetween.

Each of the sockets 86, being configured to receive one of the articulation elements 84, may be configured to permit rotation and/or pivotable movement of the socket 86 and associated limb 24 about the articulation element 84 received within the socket. As shown in FIG. 7, each of the legs 28 may include leg members 100 having first and second upper leg portions 102, 104. The first and second upper leg portions 102, 104 may include respective first and second socket portions 106, 108 that collectively form the socket 86 when the first and second upper leg portions are joined together. The first and second upper leg portions 102, 104 may be joined or bonded together at mating surfaces 109 using any suitable method, such as adhesive bonding, ultrasonic-welding, one or more friction posts 110 inserted into corresponding sockets, or the like. In some examples, the first and second upper leg portions 102, 104 may be joined together around one of the articulation elements 84 such that the articulation element may be received within and retained by the socket 86. In some examples, the upper leg portions may be fabricated or molded from a suitable thermoplastic, such as ABS.

Each of the articulation elements 84 and the corresponding ones of the sockets 86 may be shaped and/or otherwise configured to provide a desired engagement therebetween. In particular, the articulation elements 84 and the corresponding ones of the sockets 86 may be shaped and/or otherwise configured to provide or permit a desired level or type of movement, pivoting and/or rotation of the sockets relative to the articulation elements. For example, the articulation elements 84 and the corresponding ones of the sockets 86 may be configured to permit pivoting or rotation about a predetermined number of axes, such as about one, two or three axes.

As shown in the example of FIGS. 7 and 8, at least a portion of at least one of the articulation elements 84 may have a substantially spherical outer surface 112. In such an example, at least a corresponding portion of the corresponding socket 86 may have a substantially spherical surface 114 (shown in FIG. 7), which may be configured to mate with and or engage at least a portion of the substantially spherical outer surface 112 on the portion of the articulation element 84. Other nonexclusive illustrative examples of surface shapes for at least a portion of the outer surface of at least one of the articulation elements 84 and/or a corresponding portion of an inner surface of a corresponding one of the sockets 86 may include ellipsoidal and polyhedral configurations.

In some examples, the at least one of the articulation elements 84 may include at least one substantially cylindrical portion 116, as shown in FIGS. 7 and 8. In such an example, the corresponding one of the sockets 86 may include a substantially cylindrical well or receptacle 118 configured to receive and engage the substantially cylindrical portion 116 of the articulation element 84.

In some examples, at least a portion of the socket 86 and/or at least a portion of the articulation element 84 may be configured to define and/or limit pivotable movement of the associated limb 24 relative to the elongate member 82. For example, the substantially cylindrical portion 116 and/or the substantially cylindrical receptacle 118 may define an axis 119 (shown in FIGS. 5, 6 and 8) for pivotable movement of the socket 86 and associated limb 24 about the articulation element 84. In such an example, the substantially cylindrical portion 116 and/or the substantially cylindrical receptacle 118 may be configured to limit pivotable movement of the associated leg 28 relative to the elongate member 82 to being about a single axis, such as the axis 119.

In some examples, one of a corresponding set of an articulation element 84 and socket 86 may include a substantially cylindrical projection and the other of the corresponding set of an articulation element 84 and socket 86 may include a substantially cylindrical receptacle configured to receive the substantially cylindrical projection. As shown in FIGS. 7 and 8, one of the articulation elements 84 may include a substantially cylindrical projection 120 while the socket 86 includes a substantially cylindrical receptacle 122 configured to receive the substantially cylindrical projection. However, in some examples, the socket may include a substantially cylindrical projection while the articulation element may include a substantially cylindrical receptacle configured to receive the substantially cylindrical projection. For example, as shown in FIGS. 7 and 9, an opening 124 may be disposed on at least one of the projections 120, while a post 126 may be disposed within a corresponding receptacle 122, with the opening 124 being configured to engage the post 126.

In some examples, as shown in FIGS. 7 and 8, at least one of the articulation elements 84 may include a pair of opposed projections 120 extending therefrom, while the corresponding one of the sockets 86 may include a pair of opposed receptacles 122 configured to engage and receive the pair of opposed projections 120. In such an example, the pair of opposed projections 120 and/or the pair of opposed receptacles 122 may extend or be aligned along an axis, such as the axis 119, such that the leg 28 may be configured to pivot about the axis.

As used herein, substantially cylindrical elements should be understood to include elements or features that have a generally circular-cylindrical shape, as well as elements or features that have a generally ellipsoidal- or otherwise-cylindrical shape, or even a generally n-sided prism shape with a polygonal cross-section. Accordingly, in some examples, one or more of the substantially cylindrical projections 120, substantially cylindrical receptacles 122, openings 124 or posts 126 may have a polygonal cross-section, such that it has a finite number of sides. For example, the opening 124 on the substantially cylindrical projection 120 on the articulation element 84 shown in FIG. 7 has a hexagonal cross-section.

In some examples, the articulation element 84 and/or the socket 86 may be configured to provide for indexing, click-stops and/or frictional position holding of the socket 86 relative to the articulation element 84. For example, a plurality of protrusions, bumps, recesses and/or detents may be disposed on the exterior of the articulation element 84 and/or on the interior surface of the socket 86. As shown in the example of FIGS. 8 and 10, at least one of the articulation elements 84 may include at least one protrusion 128, which may be in the form of a rib extending generally transverse to the elongate member 82. By "transverse," it is meant that the indicated elements are obliquely or perpendicularly oriented. As shown in FIGS. 7 and 8, the protrusions 128 may be on the portion of the articulation element 84 having a substantially spherical outer surface.

In some examples, the joint assembly 30 may be configured to limit the range of movement, rotation and/or pivoting of the socket 86 relative to the elongate member. For example, as shown in FIG. 7, the socket 86 may include one or more features or stops 130 that may engage the elongate member 82 at predefined rotational limits and impede or prevent further rotation of the socket 86 relative to the elongate member 82.

Figure 11:
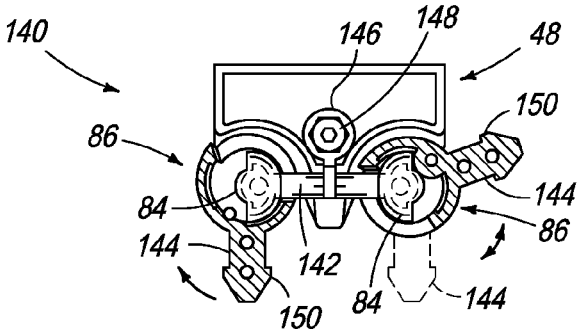
FIG. 11 is a partially cutaway view of a another nonexclusive illustrative example of a joint assembly suitable for use with the toy figure of FIG. 1, shown with the back upper leg portions removed and with the crosshatching on the front upper leg portions indicating illustrative mating surfaces thereof.

Another nonexclusive illustrative example of a joint assembly for a toy figure is shown generally at 140 in FIG. 11. Unless otherwise specified, joint assembly 140 may, but is not required to, contain at least one of the structures, components, functionalities, concepts, and/or variations described, illustrated, and/or incorporated herein. Joint assembly 140 may include an elongate member 142, a pair of articulation elements 84, a pair of sockets 86 within opposed pairs of upper leg portions 144, with each of the pair of sockets being configured to receive one of the pair of articulation elements. The elongate member 142 may include a loop 146 that may be configured to engage a corresponding post 148 within the hip region 48. Each of the opposed pairs of upper leg portions 144 may include a barbed connector post 150 that may be configured to engage and retain a suitable corresponding thigh or leg member (not shown in FIG. 11).

Figure 12:
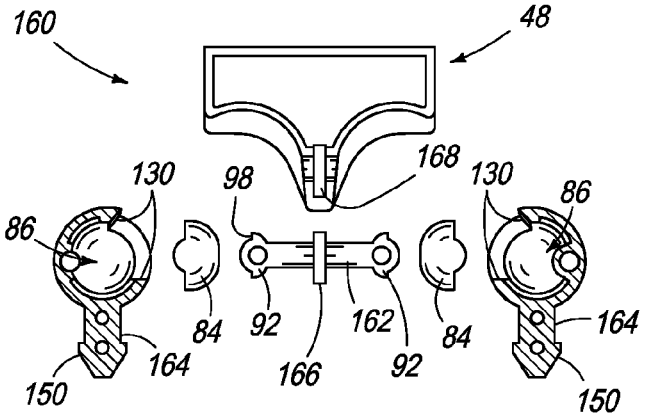
FIG. 12 is a partially cutaway exploded view of a another nonexclusive illustrative example of a joint assembly suitable for use with the toy figure of FIG. 1, shown with the back upper leg portions removed, with the crosshatching on the front upper leg portions indicating illustrative mating surfaces thereof, and with the articulation elements shown separated from the end regions of the elongate member for illustration purposes.

Another nonexclusive illustrative example of a joint assembly for a toy figure is shown generally at 160 in FIG. 12. Unless otherwise specified, joint assembly 160 may, but is not required to, contain at least one of the structures, components, functionalities, concepts, and/or variations described, illustrated, and/or incorporated herein. The joint assembly 160 may include an elongate member 162, a pair of articulation elements 84, a pair of sockets 86 within opposed pairs of upper leg portions 164, with each of the pair of sockets being configured to receive one of the pair of articulation elements.

The elongate member 162 includes a feature or tab 166 that is configured to engage a corresponding feature or recess 168 within the hip region 48.

The upper leg portions 164 shown in FIG. 12 have differently configured stops 130 as compared to the stops 130 on the upper leg portions 144 shown in FIG. 11. The stops 130 on the upper leg portions 164 are configured to permit a reduced range of rotation of the upper leg portions 164 as compared to the stops 130 on the upper leg portions 144.

It is believed that the disclosure set forth herein encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the disclosure includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the inventions of the present disclosure.

We claim:

1. A toy figure, comprising:

a torso;

an elongate member extending from the torso and having an end region;

an articulation element molded substantially around the end region and including a substantially cylindrical portion; and a limb having a socket, wherein the articulation element is received within the socket, with the socket being configured for pivotable movement about the articulation element.

2. The toy figure of claim 1, wherein the articulation element is substantially immovable relative to the end region.

3. The toy figure of claim 2, wherein the elongate member comprises a shaft section extending from the torso towards the end region, and the end region is enlarged relative to the shaft section.

4. The toy figure of claim 1, wherein the socket includes a substantially cylindrical receptacle configured to receive the substantially cylindrical portion of the articulation element, and the substantially cylindrical receptacle defines an axis for pivotable movement of the socket about the articulation element.

5. The toy figure of claim 1, wherein at least one of the socket and the articulation element is configured to limit pivotable movement of the limb relative to the elongate member to being about a single axis.

6. The toy figure of claim 5, wherein one of the articulation element and the socket includes a substantially cylindrical projection and the other of the articulation element and the socket includes a substantially cylindrical receptacle configured to receive the substantially cylindrical projection.

7. The toy figure of claim 6, wherein at least one of the substantially cylindrical projection and the substantially cylindrical receptacle has a polygonal crosssection.

8. The toy figure of claim 1, wherein at least a portion of the articulation element has a substantially spherical outer surface.

9. The toy figure of claim 1, wherein a plurality of protrusions are disposed on the exterior of the articulation element.

10. The toy figure of claim 9, wherein at least some of the plurality of protrusions comprise a rib extending transverse to the elongate member.

11. The toy figure of claim 1, wherein the elongate member comprises a first thermoplastic material, the articulation element comprises a second thermoplastic material different from the first thermoplastic material, and the articulation element is molded substantially around the end region using an insert molding process.

12. The toy figure of claim 11, wherein the first thermoplastic material is selected from the group consisting of nylon, acrylonitrile butadiene styrene and polyoxymethylene, and the second thermoplastic material is selected from the group consisting of PVC and styrene butadiene.

13. A toy figure, comprising:

a torso;

an elongate member mounted to the torso and having first and second end regions;

first and second articulation elements molded over respective ones of the first and second end regions, wherein the first and second articulation elements are substantially immovable relative to the elongate member;

a first limb having a first socket configured to receive the first articulation element and permit rotation of the first limb relative to the first articulation element; and a second limb having a second socket configured to receive the second articulation element and permit rotation of the second limb relative to the second articulation element.

14. The toy figure of claim 13, wherein each of the first and second articulation elements includes a pair of opposed projections, and each of the first and second sockets includes a pair of opposed receptacles configured to receive the corresponding pair of opposed projections.

15. The toy figure of claim 14, wherein an opening is disposed on at least one of the opposed projections, a post is disposed within a corresponding at least one of the opposed receptacles, and the opening is configured to engage the post.

16. The toy figure of claim 14, wherein each of the first and second articulation elements includes at least one protrusion extending transverse to the elongate member. to the hip member.

* * * * *